US010947032B2

(12) United States Patent
Lv

(10) Patent No.: US 10,947,032 B2
(45) Date of Patent: Mar. 16, 2021

(54) PACKAGING BOX FOR LIQUID CRYSTAL PANEL

(71) Applicant: HUIZHOU CHINA STAR OPTOELECTRONICS TECHNOLOGY CO., LTD., Guangdong (CN)

(72) Inventor: Chengling Lv, Guangdong (CN)

(73) Assignee: HUIZHOU CHINA STAR OPTOELECTRONICS TECHNOLOGY CO., LTD., Huizhou (CN)

( * ) Notice: Subject to any disclaimer, the term of this patent is extended or adjusted under 35 U.S.C. 154(b) by 413 days.

(21) Appl. No.: 15/752,795

(22) PCT Filed: Jan. 24, 2018

(86) PCT No.: PCT/CN2018/074062

§ 371 (c)(1),
(2) Date: Feb. 14, 2018

(87) PCT Pub. No.: WO2019/127795

PCT Pub. Date: Jul. 4, 2019

(65) Prior Publication Data

US 2020/0130923 A1 Apr. 30, 2020

(30) Foreign Application Priority Data

Dec. 27, 2017 (CN) ..... 201711448949.8

(51) Int. Cl.
*B65D 85/38* (2006.01)
*B65D 8/00* (2006.01)
(Continued)

(52) U.S. Cl.
CPC ..... *B65D 85/38* (2013.01); *B65D 15/22* (2013.01); *B65D 81/022* (2013.01); *B65D 61/00* (2013.01); *B65D 2585/6835* (2013.01)

(58) Field of Classification Search
USPC ..... 206/454; 220/636, 637, 646, 650, 653, 220/645, 639, 628, 9.1, 9.4; 229/199
See application file for complete search history.

(56) References Cited

U.S. PATENT DOCUMENTS 3,699,901 A 10/1972 Cook, III
4,817,812 A * 4/1989 Sarnoff ..... A47J 36/022 220/491
(Continued)

FOREIGN PATENT DOCUMENTS

CN 1621316 A 6/2005
CN 1704232 A 12/2005
(Continued)

*Primary Examiner* — Jacob K Ackun
(74) *Attorney, Agent, or Firm* — Hemisphere Law, PLLC; Zhigang Ma

(57) ABSTRACT

A packaging box for a liquid crystal panel includes a box and a reinforcing member, the box includes a bottom board and a side frame, and the reinforcing member is fixed on the bottom board. Since the reinforcing member is fixed on the bottom of the box, the supporting strength of the bottom board is enhanced. Thus, the thickness of the box is decreased, which is advantageous to decrease the thickness of the whole stacked pallet and warehousing spaces of logistics.

6 Claims, 5 Drawing Sheets

(51) Int. Cl.
*B65D 81/02* (2006.01)
*B65D 61/00* (2006.01)

(56) References Cited

U.S. PATENT DOCUMENTS 5,029,721 A * 7/1991 Timpe ..... A47J 36/022 220/573.1
5,636,759 A * 6/1997 Brummer ..... B29C 70/26 123/195 C
6,520,369 B1 * 2/2003 Cytacki ..... A47G 19/2261 220/632
8,342,350 B2 * 1/2013 Jain ..... A01K 5/0135 220/23.89
8,522,694 B2 9/2013 Linares
2005/0082286 A1 * 4/2005 Nikkhah ..... B65D 25/20 220/9.1
2008/0314913 A1 * 12/2008 Apps ..... B65D 25/24 220/628
2009/0188412 A1 7/2009 Dubois
2012/0103981 A1 * 5/2012 Warren ..... B65F 1/1415 220/9.4
2013/0299385 A1 * 11/2013 Hsiao ..... B65D 85/48 206/724
2013/0306514 A1 * 11/2013 Hu ..... B65D 81/053 206/586
2014/0008256 A1 * 1/2014 Chen ..... B65D 85/48 206/454
2014/0083893 A1 * 3/2014 Kuo ..... B65D 85/48 206/454
2014/0202909 A1 * 7/2014 Kuo ..... B65D 11/10 206/453
2014/0332432 A1 * 11/2014 Zhou ..... B65D 85/48 206/454
2015/0151870 A1 * 6/2015 Shin ..... B65D 85/48 206/557
2015/0360836 A1 * 12/2015 Shi ..... B65D 61/00 206/316.1

FOREIGN PATENT DOCUMENTS

CN 101293578 A 4/2008
CN 201169439 Y 12/2008
CN 201801081 U 4/2011
CN 102502105 A 6/2012
CN 103224099 A 7/2013
CN 104495095 A 4/2015
CN 104828398 A 8/2015
CN 205470325 U 8/2016
KR 200459909 Y1 4/2012

* cited by examiner

PACKAGING BOX FOR LIQUID CRYSTAL PANEL

RELATED APPLICATIONS

The present application is a National Phase of International Application Number PCT/CN2018/074062, filed Jan. 24, 2018, and claims the priority of China Application No. 201711448949.8, filed Dec. 27, 2017.

FIELD OF THE DISCLOSURE

The disclosure relates to a packaging technical field for a liquid crystal panel, and more particularly to a packaging box for a liquid crystal panel.

BACKGROUND

Presently, a liquid crystal panel (Open Cell) is supported by a tray. In order to cushion and protect the liquid crystal panel, thee tray is made of expandable polyethylene (EPE) and expanded polypropylene (EPP). The conventional tray packaging structure consists of a glass-loading surface and a side surface of a box. In order to protect the liquid crystal panel during a transporting process, the glass-loading surface is thicker and has some reinforcing structures. The whole box has a larger number of materials. However, the foaming materials are expensive. When the size of the liquid crystal panel is larger, how to decrease the packaging cost is an important trend that a panel industry researches.

SUMMARY

A technical problem to be solved by the disclosure is to provide a packaging box for a liquid crystal panel having the lower cost and larger supporting strength.

An objective of the disclosure is achieved by following embodiments.

A packaging box for a liquid crystal panel, comprising a box and a reinforcing member, the box comprises a bottom board and a side frame thereon, and the reinforcing member is fixed on the bottom board.

In an embodiment, the bottom board and the side frame form an accommodation recess that accommodates a liquid crystal panel and the reinforcing member is fixed to a side of the bottom board far away from the accommodation recess.

In an embodiment, a part of a surface of the bottom board far away from the accommodation recess is recessed to form a first position-limited groove, a shape of the first position-limited groove matches a shape of reinforcing member, and the reinforcing member is arranged in the first position-limited groove.

In an embodiment, a depth of the first position-limited groove is larger than a thickness of the reinforcing member.

In an embodiment, the packaging box for the liquid crystal panel further comprises a plurality of locking members, the reinforcing member is provided with a plurality of locking holes, and the plurality of locking members respectively penetrate through the plurality of locking holes to lock the reinforcing member to the first position-limited groove.

In an embodiment, the reinforcing member further comprises a first reinforcing bar and a second reinforcing bar that are intersected and connected with each other, the first position-limited groove comprises a first groove and a second groove respectively arranged along diagonals of the bottom board, and the first reinforcing bar and the second reinforcing bar are respectively arranged in the first groove and the second groove.

In an embodiment, the reinforcing member further comprises a rhombic third reinforcing bar, sides of the third reinforcing bar are respectively connected with the first reinforcing bar and the second reinforcing bar, and a center of the third reinforcing bar coincides with an intersection of the first reinforcing bar and the second reinforcing bar.

In an embodiment, the reinforcing member further comprises a fourth reinforcing bar and a fifth reinforcing bar that are perpendicularly connected with each other, a length of the fourth reinforcing bar matches a width of the bottom board, a length of the fifth reinforcing bar matches a length of the bottom board, the fourth reinforcing bar and the fifth reinforcing bar are respectively connected with the first reinforcing bar and the second reinforcing bar, and an intersection of the fourth reinforcing bar and the fifth reinforcing bar coincides with an intersection of the first reinforcing bar and the second reinforcing bar.

In an embodiment, an inner wall of the side frame is provided with second position-limited grooves connected with the first position-limited groove, and ends of the reinforcing member near the inner wall of the side frame are provided with extending portions inserted into the second position-limited grooves.

In an embodiment, two opposite surface of the side frame are respectively provided with a convex portion and a concave portion, a shape of the convex portion matches a shape of the concave portion, the convex portion is inserted into the concave portion of another liquid crystal panel stacked above the box, and the concave portion is inserted with the convex portion of another liquid crystal panel stacked below the box.

For the packaging box for the liquid crystal panel of the present disclosure, the supporting strength of the bottom board is enhanced since the reinforcing member is fixed on the bottom of the box. Thus, the thickness of the box is decreased, which is advantageous to decrease the thickness of the whole stacked pallet and warehousing spaces of logistics.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

In order to understand the above objectives, features and advantages of the present disclosure more clearly, the present disclosure is described in detail below with references to the accompanying drawings and specific embodiments. The present disclosure is only to exemplify the present disclosure but not to limit the scope of the present disclosure.

Figure 1:
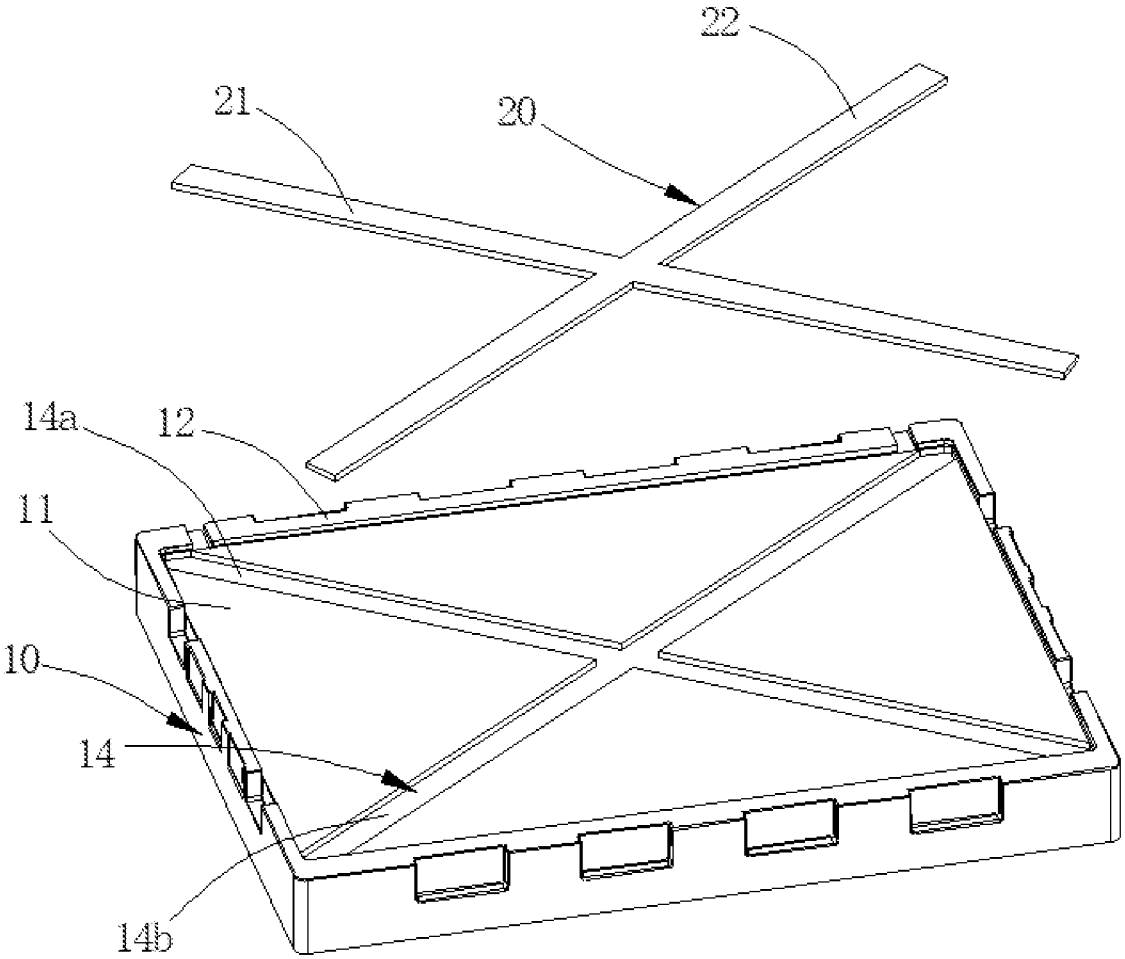
FIG. 1 is an exploded schematic view of a packaging box for a liquid crystal panel according to an embodiment of the disclosure.
Figure 2:
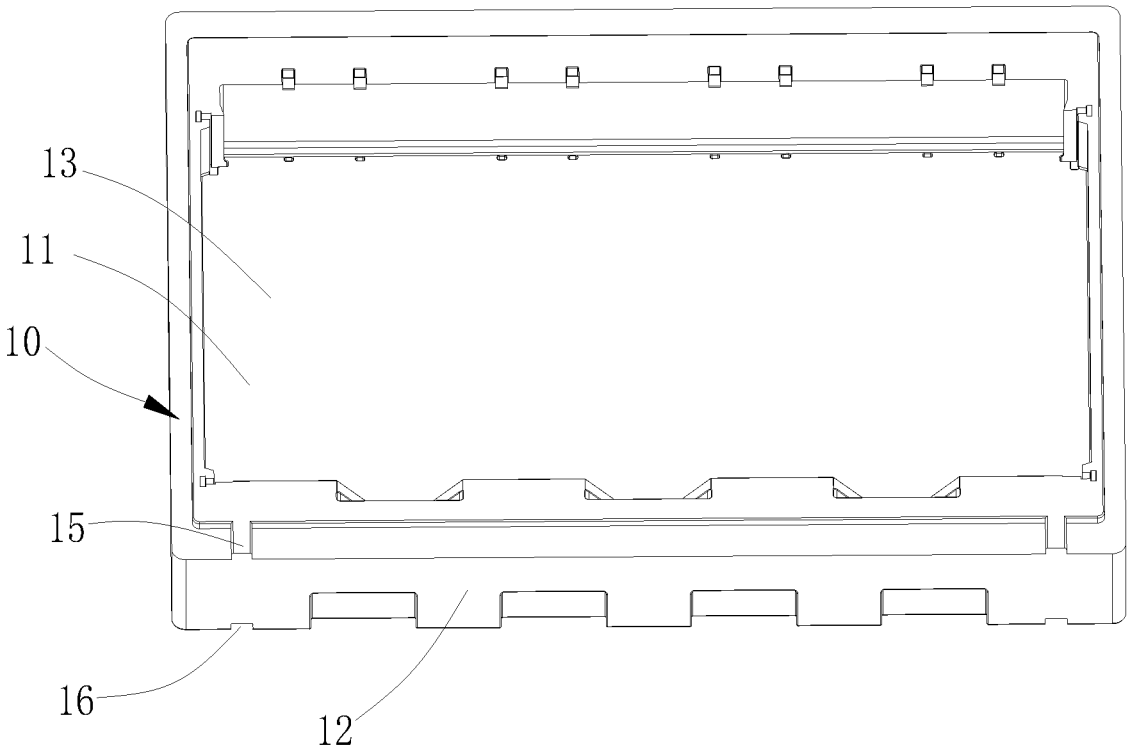
FIG. 2 is a structural schematic view of packaging a liquid crystal panel according to an embodiment of the disclosure.

Refer to FIG. 1 and FIG. 2. According to an embodiment, the present disclosure provides a packaging box for a liquid crystal panel, which comprises a box 10 and a reinforcing member 20. The box 10 comprises a bottom board 11 and a side frame 12 thereon. The reinforcing member 20 is fixed on the bottom board 11. The reinforcing member 20 improves the supporting strength of the bottom board 11.

In a preferred embodiment, the bottom board 11 has a shape of a rectangle and the side frame 12 has a shape of a rectangle. The bottom board 11 and the side frame 12 forms an accommodation recess 13 that accommodates a liquid crystal panel inside. The reinforcing member 20 is fixed to a side of the bottom board 11 far away from the accommodation recess 13, which prevents the reinforcing member 20 from touching and causing damage to the liquid crystal panel accommodated in the accommodation recess 13.

Furthermore, a part of a surface of the bottom board 11 far away from the accommodation recess 13 is recessed to form a first position-limited groove 14, a shape of the first position-limited groove 14 matches a shape of reinforcing member 20, and the reinforcing member 20 is arranged in the first position-limited groove 14. Besides, a depth of the first position-limited groove 14 is larger than a thickness of the reinforcing member 20, such that the reinforcing member 20 is stably connected with the bottom board 11. The reinforcing member 20 is completely accommodated in the first position-limited groove 14, which prevents the reinforcing member 20 from touching and causing damage to a liquid crystal panel in another box stacked below the box 10 and decreases the whole thickness of the packaging box.

Furthermore, the packaging box for the liquid crystal panel further comprises a plurality of locking members, the reinforcing member 20 is provided with a plurality of locking holes, and the plurality of locking members respectively penetrate through the plurality of locking holes to lock the reinforcing member 20 to the first position-limited groove 14 to guarantee that the reinforcing member 20 is stably connected with the box. In other embodiments, the reinforcing member 20 is stably fixed in the first position-limited groove 14. Alternatively, the reinforcing member 20 is fixed and connected to the bottom board 11 using injection molding, such that the reinforcing member 20 is more stably connected to the bottom board 11.

In a preferred embodiment, the reinforcing member 20 further comprises a first reinforcing bar 21 and a second reinforcing bar 22 that are intersected and connected with each other. In other words, the reinforcing member 20 has a shape of X. The first position-limited groove 14 comprises a first groove 14*a* and a second groove 14*b* respectively arranged along diagonals of the bottom board 11, and the first reinforcing bar 21 and the second reinforcing bar 22 are respectively arranged in the first groove 14*a* and the second groove 14*b*. The thicknesses of the first reinforcing bar 21 and the second reinforcing bar 22 match the lengths of the diagonals of the bottom board 11 to stably support the bottom board 11.

Figure 3:
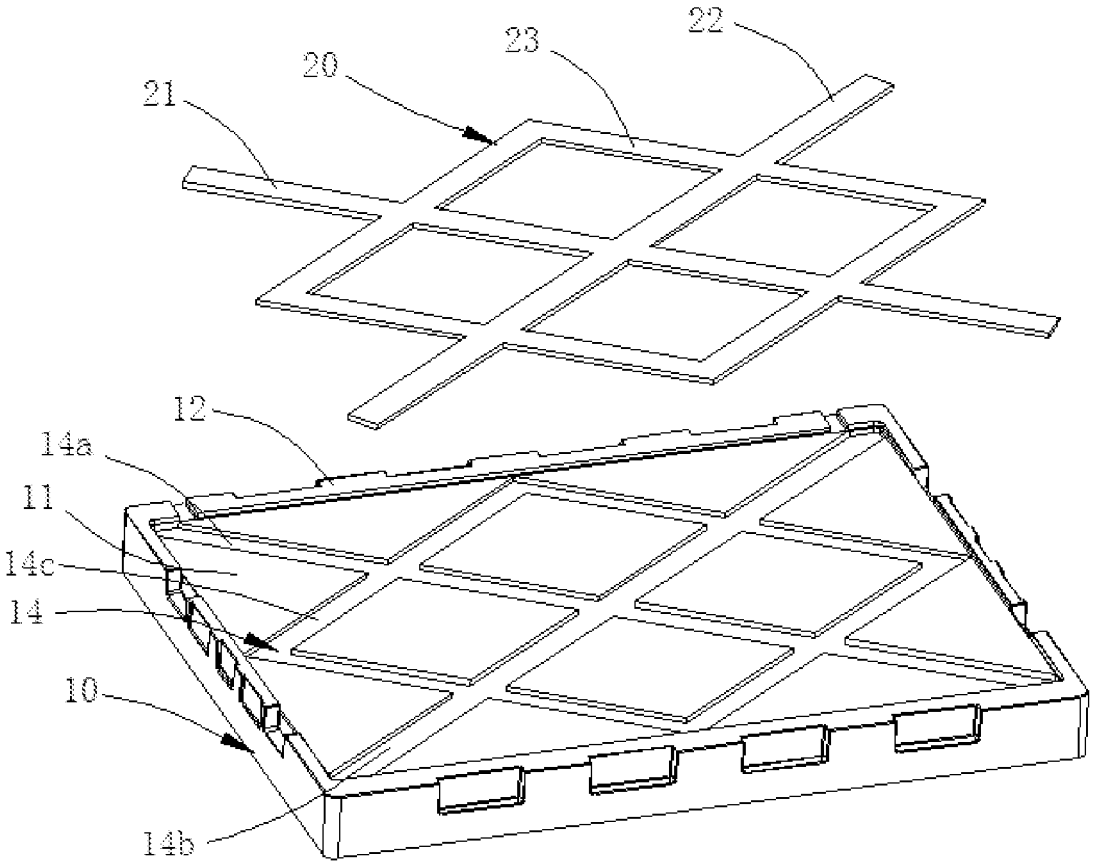
FIG. 3 is an exploded schematic view of a packaging box for a liquid crystal panel according to another embodiment of the disclosure.

Refer to FIG. 3. Furthermore, the reinforcing member 20 further comprises a rhombic third reinforcing bar 23, sides of the third reinforcing bar 23 are respectively connected with the first reinforcing bar 21 and the second reinforcing bar 22, and a center of the third reinforcing bar 23 coincides with an intersection of the first reinforcing bar 21 and the second reinforcing bar 22. Correspondingly, the first position-limited groove 14 further comprises a rhombic third groove 14*c*. The third reinforcing bar 23 is arranged in the third groove 14*c*. The first groove 14*a*, the second groove 14*b* and the third groove 14*c* divides the bottom board 11 into a plurality of small regions. Each small region is supported by the corresponding parts of the reinforcing member 20 to enhance the supporting strength of the bottom board 11.

Figure 4:
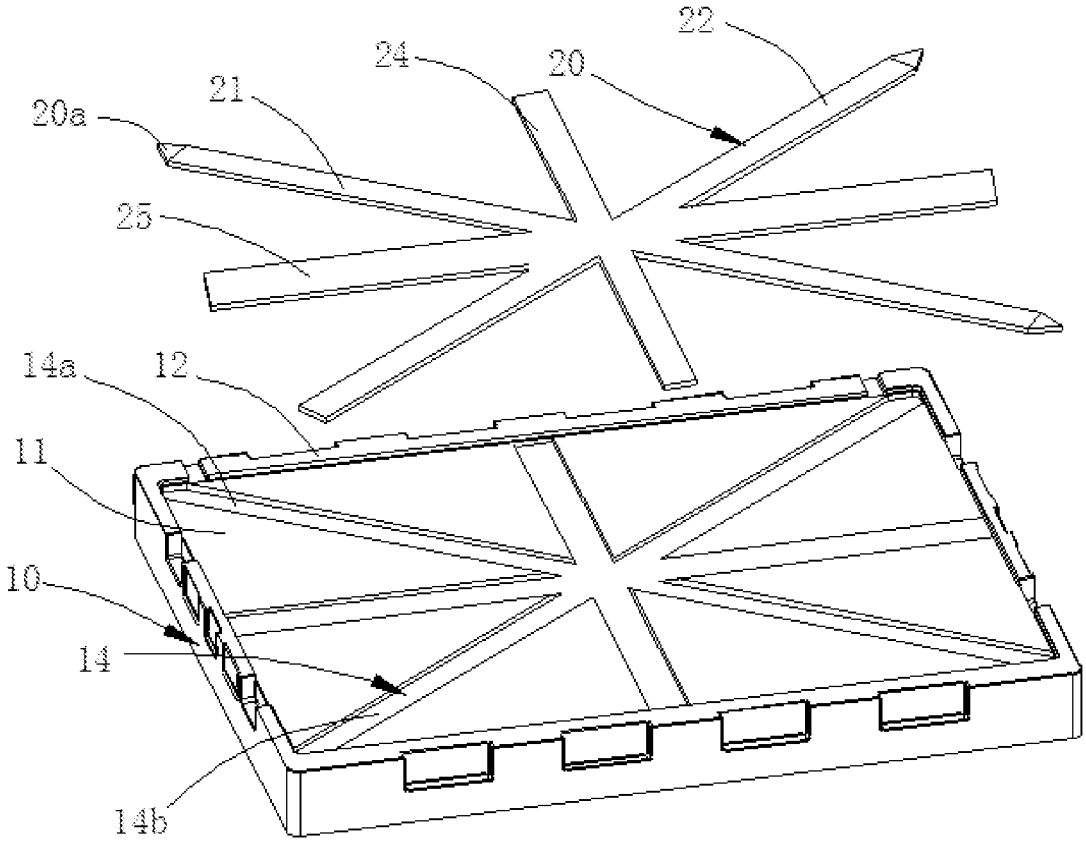
FIG. 4 is an exploded schematic view of a packaging box for a liquid crystal panel according to yet another embodiment of the disclosure.

Refer to FIG. 4. In some embodiments, the reinforcing member 20 further comprises a fourth reinforcing bar 24 and a fifth reinforcing bar 25 that are perpendicularly and crosswise connected with each other. The fourth reinforcing bar 24 and the fifth reinforcing bar 25 form a cross structure. A length of the fourth reinforcing bar 24 matches a width of the bottom board 11, a length of the fifth reinforcing bar 25 matches a length of the bottom board 11, the fourth reinforcing bar 24 and the fifth reinforcing bar 25 are respectively connected with the first reinforcing bar 21 and the second reinforcing bar 22, and an intersection of the fourth reinforcing bar 24 and the fifth reinforcing bar 25 coincides with an intersection of the first reinforcing bar 21 and the second reinforcing bar 22. In this way, the reinforcing member 20 has a pattern of British "Union Jack" to completely support the bottom board 11 and improve the supporting strength of the bottom board 11.

Figure 5:
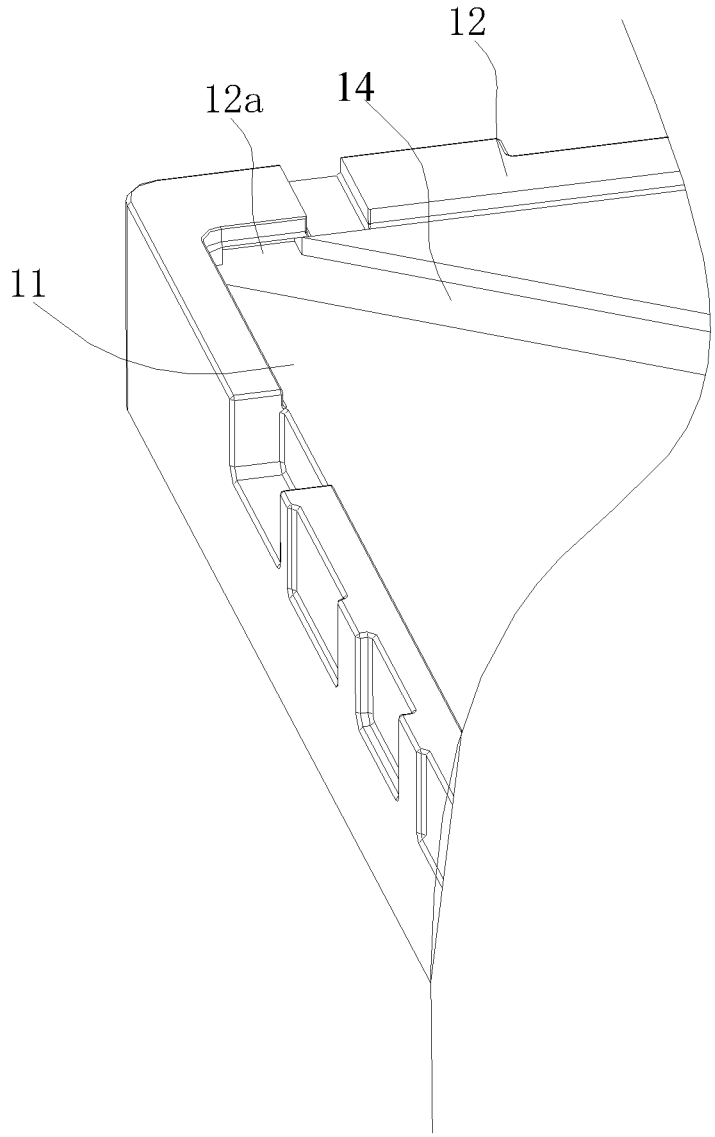
FIG. 5 is a partial enlarged schematic view of a packaging box for a liquid crystal panel in FIG. 4.

In a preferred embodiment, an inner wall of the side frame 12 is provided with second position-limited grooves 12*a* connected with the first position-limited groove 14, and ends of the reinforcing member 20 near the inner wall of the side frame 12 are provided with extending portions 20*a* inserted into the second position-limited grooves 12*a*, as shown in FIG. 5. In this way, the reinforcing member 20 is more stably connected with the box 10. The reinforcing member 20 supports the bottom board 11 and the side frame 12 to enhance the whole supporting strength of the box 10.

Furthermore, the inner wall of each corner of the side frame 12 is provided with a second position-limited groove. Two ends of the first reinforcing bar 21 are respectively provided with two extending portions 20*a*. Two ends of the second reinforcing bar 22 are respectively provided with two extending portions 20*a*. Each extending portion 20*a* is correspondingly inserted into the second position-limited groove to uniformly support the side frame 12.

In a preferred embodiment, the reinforcing member 20 may be made of steel with higher strength or aluminum alloy with light mass. The reinforcing bars may be soldered. In other embodiments, the material of the reinforcing member 20 may be stamped out and molded. Then, the molded material is cut to form a reinforcing member 30 having a predetermined shape. Alternatively, a reinforcing member 30 having a predetermined shape is formed by casting.

In a preferred embodiment, two opposite surface of the side frame 12 are respectively provided with a convex portion 15 and a concave portion 16, and a shape of the convex portion 15 matches a shape of the concave portion 16. When a plurality of packaging boxes for liquid crystal panels are stacked, the convex portion 15 is inserted into the concave portion 16 of another liquid crystal panel stacked above the box, and the concave portion 16 is inserted with the convex portion 15 of another liquid crystal panel stacked below the box. In this way, the stability of the stacked boxes is improved.

For the packaging box for the liquid crystal panel of the present disclosure, the supporting strength of the bottom board is enhanced since the reinforcing member is fixed to the bottom of the box. Thus, the thickness of the box is decreased, which is advantageous to decrease the thickness of the whole stacked pallet and warehousing spaces of logistics.

The foregoing contents are detailed description of the disclosure in conjunction with specific preferred embodiments and concrete embodiments of the disclosure are not limited to these description. For the person skilled in the art of the disclosure, without departing from the concept of the disclosure, simple deductions or substitutions can be made and should be included in the protection scope of the application.

What is claimed is:

1. A packaging box for a liquid crystal panel, comprising a box and a reinforcing member, wherein the box comprises a bottom board and a side frame disposed on the bottom board, and the reinforcing member is fixed on the bottom board;

wherein the bottom board and the side frame enclose an accommodation recess that accommodates a liquid crystal panel inside, and the reinforcing member is fixed to a side of the bottom board far away from the accommodation recess;

wherein a part of a surface of the bottom board far away from the accommodation recess is recessed to form a first position-limited groove, a shape of the first position-limited groove matches a shape of reinforcing member, and the reinforcing member is arranged in the first position-limited groove; and wherein an inner wall of the side frame is provided with second position-limited grooves connected with the first position-limited groove, and ends of the reinforcing member near the inner wall of the side frame are provided with triangle-shaped extending portions inserted into the second position-limited grooves.

2. The packaging box for the liquid crystal panel according to claim 1, wherein the reinforcing member further comprises a first reinforcing bar and a second reinforcing bar that are intersected and connected with each other, the first position-limited groove comprises a first groove and a second groove respectively arranged along diagonals of the bottom board, and the first reinforcing bar and the second reinforcing bar are respectively arranged in the first groove and the second groove.

3. The packaging box for the liquid crystal panel according to claim 2, wherein the reinforcing member further comprises a fourth reinforcing bar and a fifth reinforcing bar that are perpendicularly and crosswise connected with each other, a length of the fourth reinforcing bar matches a width of the bottom board, a length of the fifth reinforcing bar matches a length of the bottom board, the fourth reinforcing bar and the fifth reinforcing bar are respectively connected with the first reinforcing bar and the second reinforcing bar, and an intersection of the fourth reinforcing bar and the fifth reinforcing bar coincides with an intersection of the first reinforcing bar and the second reinforcing bar.

4. The packaging box for the liquid crystal panel according to claim 1, wherein a depth of the first position-limited groove is larger than a thickness of the reinforcing member.

5. The packaging box for the liquid crystal panel according to claim 4, wherein the reinforcing member further comprises a first reinforcing bar and a second reinforcing bar that are intersected and connected with each other, the first position-limited groove comprises a first groove and a second groove respectively arranged along diagonals of the bottom board, and the first reinforcing bar and the second reinforcing bar are respectively arranged in the first groove and the second groove.

6. The packaging box for the liquid crystal panel according to claim 5, wherein the reinforcing member further comprises a fourth reinforcing bar and a fifth reinforcing bar that are perpendicularly connected with each other, a length of the fourth reinforcing bar matches a width of the bottom board, a length of the fifth reinforcing bar matches a length of the bottom board, the fourth reinforcing bar and the fifth reinforcing bar are respectively connected with the first reinforcing bar and the second reinforcing bar, and an intersection of the fourth reinforcing bar and the fifth reinforcing bar coincides with an intersection of the first reinforcing bar and the second reinforcing bar.

* * * * *